US009488119B2

(12) United States Patent
Frelich

(10) Patent No.: US 9,488,119 B2
(45) Date of Patent: Nov. 8, 2016

(54) AUTOADAPTIVE ENGINE IDLE SPEED CONTROL

(71) Applicant: Caterpillar Paving Products Inc., Brooklyn Park, MN (US)

(72) Inventor: Toby A. Frelich, St. Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 94 days.

(21) Appl. No.: 14/503,538

(22) Filed: Oct. 1, 2014

(65) Prior Publication Data

US 2015/0016886 A1 Jan. 15, 2015

Related U.S. Application Data

(63) Continuation of application No. 13/592,705, filed on Aug. 23, 2012, now abandoned.

(51) Int. Cl.

| | |
|---|---|
| ***E01C 19/00*** | (2006.01) |
| ***F02D 41/08*** | (2006.01) |
| ***F02D 41/02*** | (2006.01) |
| ***F02D 31/00*** | (2006.01) |

(52) U.S. Cl.

CPC ..... *F02D 41/083* (2013.01); *E01C 19/002* (2013.01); *F02D 31/008* (2013.01); *F02D 41/0205* (2013.01); *F02D 41/0225* (2013.01); *F02D 2200/10* (2013.01); *F02D 2200/604* (2013.01); *F02D 2200/606* (2013.01)

(58) Field of Classification Search

CPC ... F02D 41/083; F02D 2200/10; E01C 19/00
USPC ..... 404/84.1
See application file for complete search history.

(56) References Cited

U.S. PATENT DOCUMENTS

| | | | | |
|---|---|---|---|---|
| 5,224,045 | A | 6/1993 | Stasell | |
| 7,085,645 | B2 * | 8/2006 | Matsuda | F02D 31/002 123/350 |
| 7,353,105 | B2 | 4/2008 | Mino et al. | |
| 7,673,815 | B2 * | 3/2010 | Schroeder | E01C 23/22 239/146 |
| 7,856,301 | B2 | 12/2010 | Sjoegren et al. | |
| 7,962,768 | B2 | 6/2011 | Grill et al. | |
| 8,374,755 | B2 | 2/2013 | Lin et al. | |
| 2004/0088103 | A1 | 5/2004 | Itow et al. | |

(Continued)

FOREIGN PATENT DOCUMENTS

| | | |
|---|---|---|
| EP | 0391029 | 10/1990 |

*Primary Examiner* — Gary Hartmann
(74) *Attorney, Agent, or Firm* — Andrew A. Phillips

(57) ABSTRACT

A machine engine idle speed control system may include an automated autoadaptive mode to supplement typical economy and normal power modes. The autoadaptive mode may afford an operator with an automated option to optimize fuel economy and lower engine/machine noise. The autoadaptive mode may initially default to a typical lower engine idle speed of the economy mode. However, as the machine workload rises, demands on the engine may become greater, and at a predetermined threshold of engine workload the engine idle speed may be automatically increased to a higher set point. The engine control may then remain at the higher idle speed until engine load is reduced to some predetermined target, and/or after a certain time period has elapsed. The time period may be controlled by a configurable delay timer to avoid unnecessary/undesirable cycling between modes. In addition, an operator may always intervene to increase or decrease engine idle speed.

10 Claims, 3 Drawing Sheets

(56) References Cited

U.S. PATENT DOCUMENTS

| | | | | |
|---|---|---|---|---|
| 2008/0092849 | A1 | 4/2008 | Mizuguchi | |
| 2010/0196096 | A1* | 8/2010 | Halonen | E01C 19/405 404/84.1 |
| 2010/0235060 | A1 | 9/2010 | Yamada | |
| 2011/0010058 | A1 | 1/2011 | Saito et al. | |
| 2014/0053801 | A1* | 2/2014 | Frelich | F02D 41/0205 123/339.21 |
| 2014/0083392 | A1* | 3/2014 | Cattani | F02D 41/08 123/339.24 |
| 2014/0083393 | A1* | 3/2014 | Cattani | F02D 41/08 123/350 |
| 2015/0300275 | A1* | 10/2015 | Tiedemann | B60W 10/06 404/84.05 |

* cited by examiner

AUTOADAPTIVE ENGINE IDLE SPEED CONTROL

RELATED APPLICATIONS

The present disclosure claims the right to priority based on, and is a continuation of U.S. patent application Ser. No. 13/592,705 filed on Aug. 23, 2012, which is fully incorporated herein.

TECHNICAL FIELD

This disclosure relates to systems and apparatus for optimizing fuel usage and for reducing overall engine noise under a range of engine operating conditions encountered by a work machine. More particularly, the disclosure relates to an automated engine idle speed control system adapted to respond directly to variations in machine workloads to improve fuel efficiencies and lower noise profiles over those of conventionally available engine idle speed control systems.

BACKGROUND

Among numerous machines, including paving machines, front wheel loaders, excavators, road graders, milling machines, and construction machines, the demand for more sophisticated engine controls is ever increasing.

During roadbed paving operations, and particularly at times of reduced workloads, less than full engine power may be required for effective performance of a paving machine being utilized, as one example. Such periods of reduced workload present opportunities for increasing fuel efficiency as well as for reducing machine noise. Many conventional machines supplement a so-called normal power idle mode with an economy idle mode for such purpose. The economy mode offers a relatively low engine idle speed during periods of reduced workload demand, while permitting an operator to switch back to normal power (higher) engine idle speed whenever the machine may encounter higher workloads. Although the normal power engine idle mode generally produces a relatively high idle speed irrespective of workload, the normal mode has an advantage of being more immediately responsive to abrupt changes in workload demand. For example, under the normal power mode, there is less risk of the engine becoming bogged down upon encounters of transient and/or spontaneous increases in workload demand.

Several efforts have been made to enhance engine control responsiveness as a function of anticipated loads. However, most of these efforts have resulted in relatively complex and expensive systems. For example, U.S. Pat. No. 7,353,105 discloses an engine control device for construction machinery that involves controlling engine idle speeds between a normal power mode and an energy-saving mode. However, that particular control device relies on inputs that include actual vehicle speeds, and incorporates an onboard controller for sending command signals to an electronic control module based on sensed values of the vehicle speed. Responsively to such inputs, the device switches engine idle speeds between those of normal power and energy-saving modes.

Accordingly, it may be beneficial to provide a simpler engine speed control system; albeit one more directly tied to engine workload demand, as opposed to machine speed and other external and/or indirect variables.

SUMMARY OF THE DISCLOSURE

In one disclosed embodiment, an engine idle speed control system provides an economy mode, a normal power mode, and an autoadaptive mode as will be described herein, to afford an operator with a greater variety of options to optimize fuel economy and to reduce overall machine noise. In the economy mode, the engine speed may be set for a relatively low idle engine speed threshold. Irrespective of workload demands, that speed may be maintained until an operator intervenes to switch to a higher idle speed.

In the power mode, the engine may be maintained at a relatively high threshold idle engine speed under preset conditions; i.e. whenever the machine is not in a neutral gear and/or whenever the parking brake is off. Irrespective of workload demands as in the economy mode, in the power mode the higher engine idle speed may be maintained until an operator intervenes to change the engine idle speed to a higher value or lower value.

In accordance with this disclosure an autoadaptive mode may offer a simple automated control system in which the machine engine may initially default to the lower speed of the standard economy mode. However, as workload demands on the machine may increase, and demand on the engine may commensurately become greater, at a predetermined value the engine speed may be automatically increased up to a preset higher idle point. The engine may then remain at the new idle speed until the workload demand is reduced to some predetermined workload percentage, and/or after a time period has elapsed. To avoid unnecessary/undesirable cycling between modes, such time periods may be set and controlled by an operator configurable delay timer. Again, however, the operator may in real time intervene to either reduce or increase, and hence override, any given engine idle speed.

In accordance with one aspect of the disclosure, the autoadaptive control mode may automatically command the engine to maintain a low idle speed during periods of low workload demand.

In accordance with another aspect of the disclosure, the autoadaptive mode may be selectively engaged whenever the machine is not in a neutral gear and/or whenever the parking brake is off.

In accordance with a further aspect of the disclosure, the autoadaptive mode may cause the engine speed to be automatically increased from a preset low idle set point to a preset higher idle set point when workload on the machine has increased to a predetermined threshold percentage of target workload.

In accordance with a further aspect of the disclosure, the autoadaptive mode may cause the engine speed to be automatically decreased from the preset higher idle set point to the lower idle set point when the workload on the machine has decreased to a predetermined threshold percentage of target workload.

In accordance with a still further aspect of the disclosure, the autoadaptive mode may be selectively deactivated at any time in favor of either the economy or power modes.

DETAILED DESCRIPTION

Figure 1:
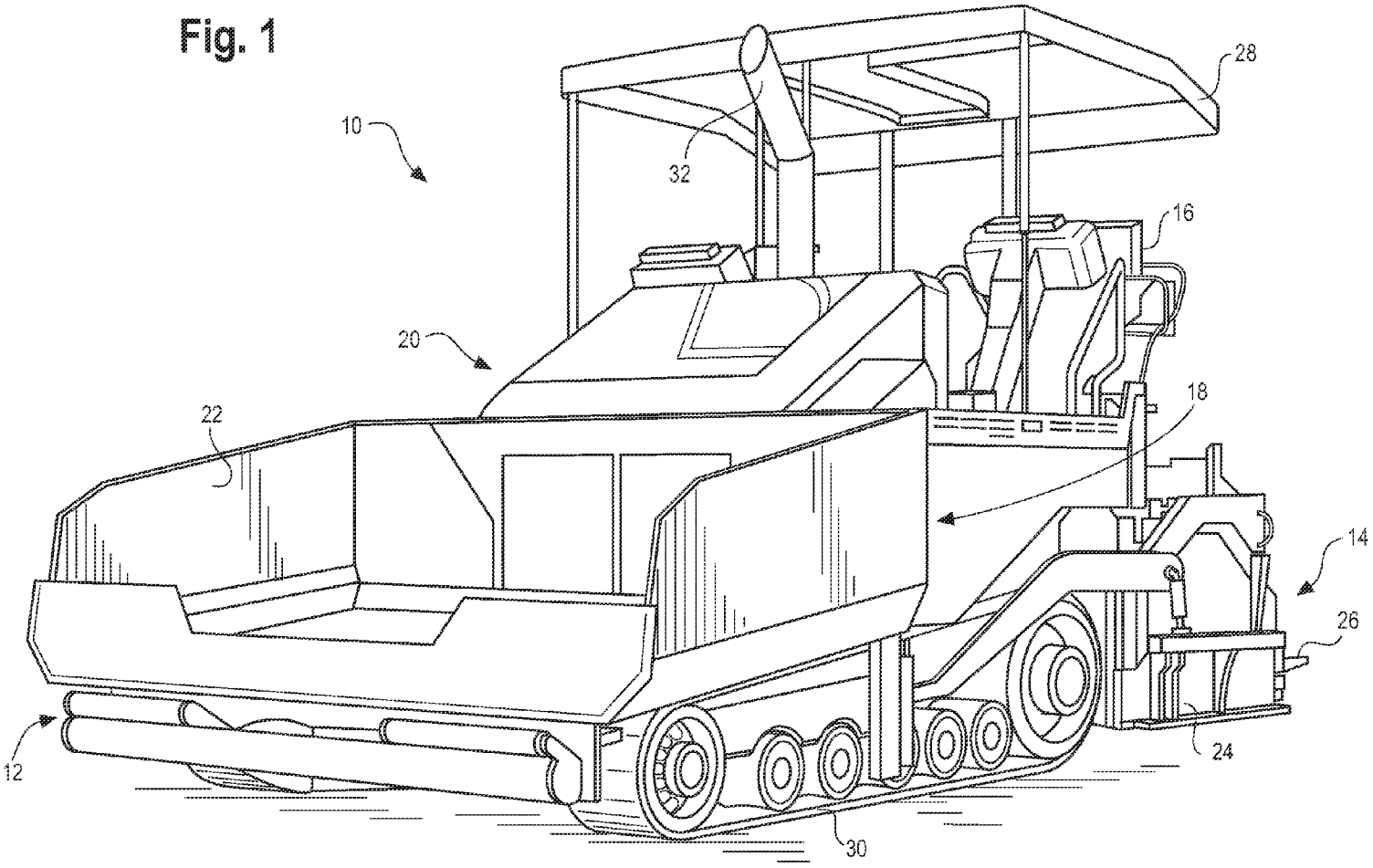
FIG. 1 is a perspective view of a paving machine that may incorporate the disclosed autoadaptive engine speed control system.

Referring initially to FIG. 1, a paving machine 10 is depicted in a perspective view, revealing a front end 12 and a rear end 14. The paving machine 10 may incorporate an operator station 16, including a seat and operating controls. An engine compartment 18 may contain an engine (not shown) situated below a radiator cooling unit 20.

The paving machine 10 may incorporate a hopper 22 at its front end 12. When the machine 10 is being operated to pave a road bed, for example, the hopper 22 is typically loaded by a dump truck (not shown) with paving materials (not shown), such as an asphalt mix, as will be appreciated by those skilled in the art. The paving machine 10 may also be utilized for roller-compacted concrete, or for aggregates of stone and sand for road bed underlayment and/or road base preparation.

A conveyor unit (not shown) may move the paving materials from the hopper 22 into a plurality of material spreading augers 24 at the rear end 14 of the machine 10. The spreading augers 24 may be adapted to spread the material over a road bed (not shown). A screed 26, also situated at the rear end 14 and immediately behind the augers 24, may incorporate hydraulically vibrated plates adapted to flatten and compact the material over the road bed. The screed may also be capable of contouring the material over the surface of the road bed.

The machine 10 may incorporate a hood 28, as a structure for shading and otherwise protecting the machine operator from exposure to weather elements, such as rain or direct sunlight. The machine 10 may roll on tracks 30, as shown, or may alternatively move on wheels (not shown). Finally, an engine exhaust stack 32 may protrude vertically from the engine compartment 18 to direct engine exhaust particulates upwardly and otherwise generally away from the operator station 16.

Figure 2:
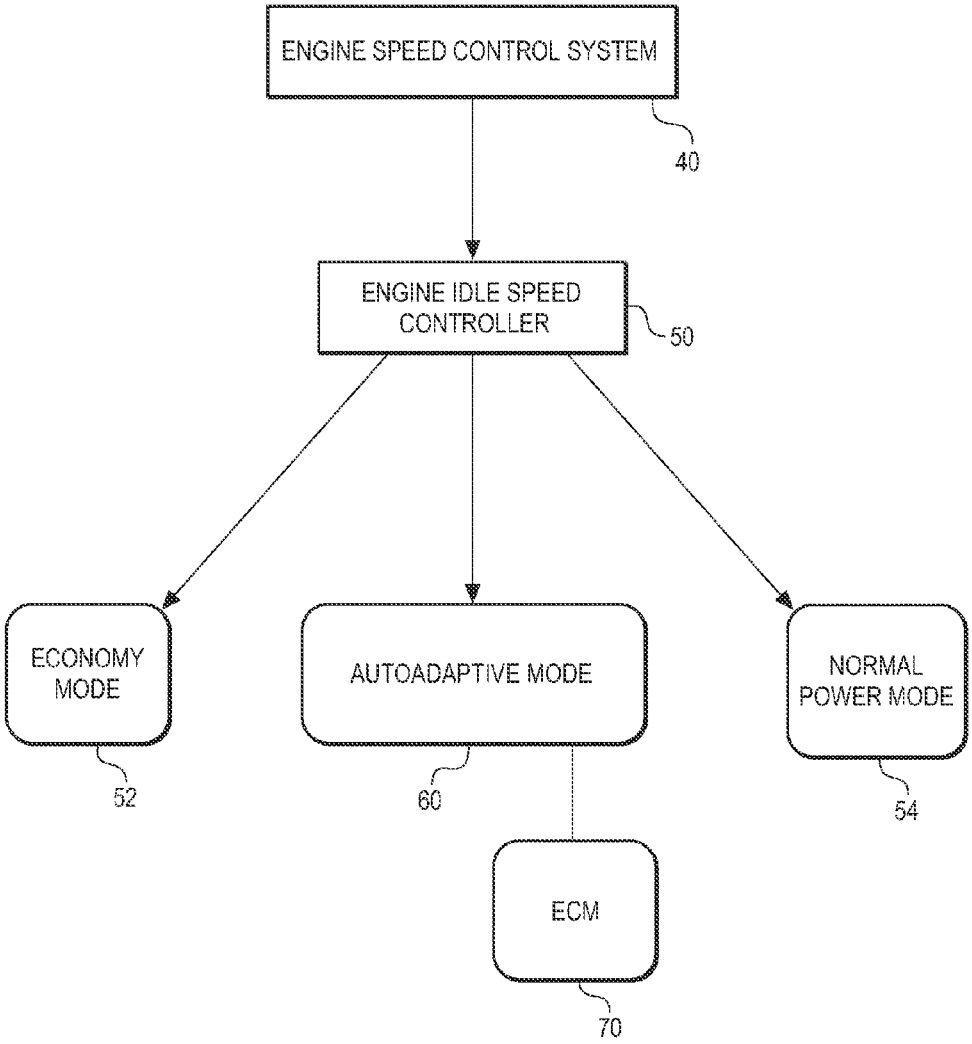
FIG. 2 is a schematic representation of one exemplary embodiment of the engine speed control system disclosed herein.

Referring now to FIG. 2, an engine speed control system 40 (shown schematically) may be adapted to control an engine idle speed controller 50 (also shown schematically). An operator may engage the engine idle speed controller 50 for selection among three distinct modes, including an economy mode 52, a normal power mode 54, and an autoadaptive mode 60, as depicted.

It may be appreciated that during paving operations, there are times when less than full engine power may be required. In fact, the engine may often be subject to very small workload or machine demands. During the latter situations the machine 10 may be operated at lower engine speeds to optimize fuel efficiency, and/or to produce lower engine/machine noise. For example, and particularly when such low workload conditions are relatively constant, the operator may choose to select the economy mode 52, which may be adapted to produce a low engine idle, on a consistent basis, and irrespective of workload demand on the machine 10.

Under consistently higher demand workloads, however, the machine 10 may require faster idle speeds to assure that the engine does not become bogged down. During such instances, a constantly high engine power may be required, and an operator may desire a relatively high engine idle to assure appropriate accommodation of the relatively high machine workload demand. As such, the operator may choose to select the normal power mode 54 to the produce an improved engine response to a consistently high workload demand on the machine 10.

In contrast to the above-described relatively constant workload demand periods, there may be times during machine operation when varying workload demands may be encountered. Rather than to endure a burden of having to manually switch back and forth between the economy and normal power modes, the disclosed autoadaptive mode 60 may be utilized to avoid potentially tiresome operator interventions. During such instances, the operator may desire to switch from the economy mode or the normal power mode to the automated adaptive mode 60.

Figure 3:
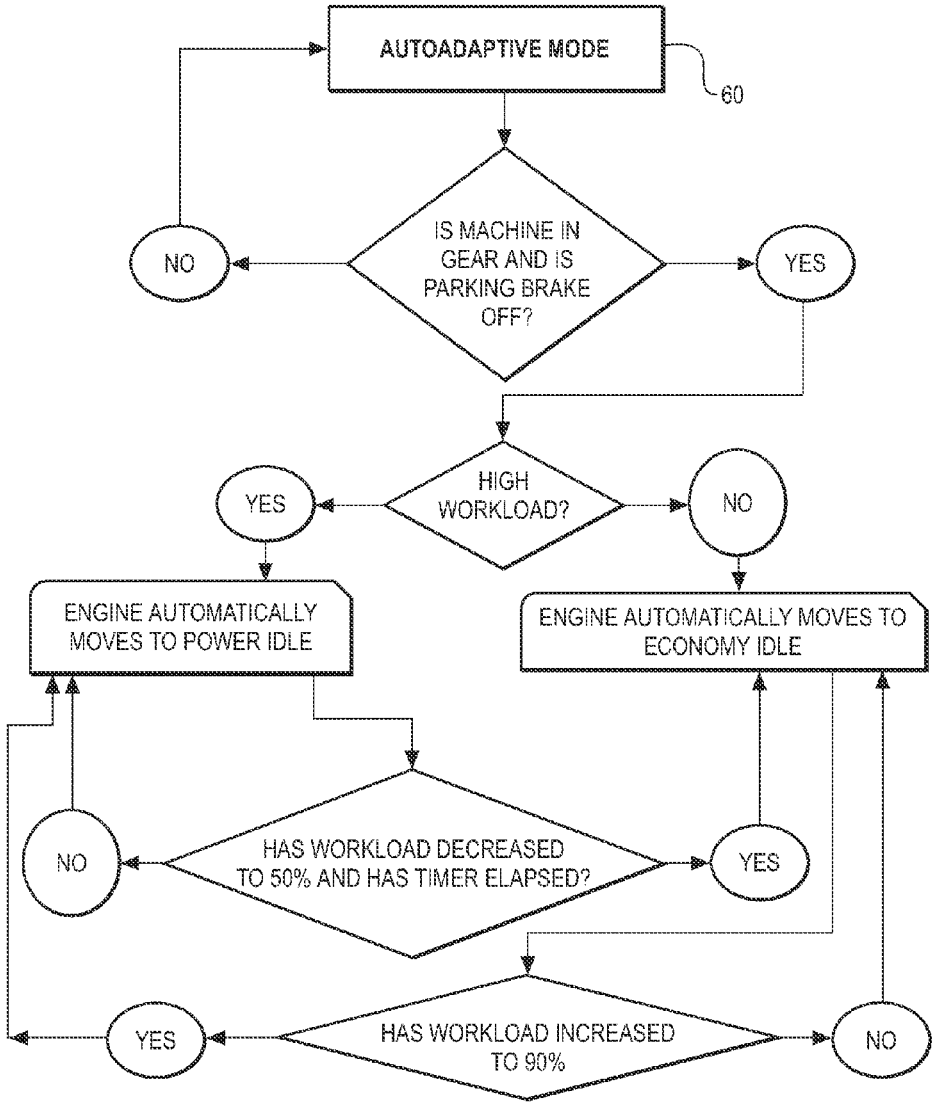
FIG. 3 is a flowchart detailing one exemplary sequence of operation or algorithm of the disclosed autoadaptive mode of the engine idle control system.

Referring now to FIG. 3, a flowchart reveals one exemplary algorithm that may provide for the autoadaptive mode 60 to automatically achieve lower engine speeds and engine/machine noise at appropriate times. In the autoadaptive mode 60, the engine speed may normally default to a low idle condition, as in the normal economy mode 52. The autoadaptive mode 60, as an automated mode, may offer the best attributes of both economy and normal power modes 52, 54. For example, during operation of the autoadaptive mode 60, the controller 50 may automatically default to a condition of low engine idle whenever the machine is not moving; i.e., either not in gear or having the parking brake engaged, or whenever the machine is subject to low workload demands, as suggested in FIG. 3.

Thus it may be appreciated that the autoadaptive mode 60 may include an electronic control module (ECM) 70 having pre-programmed settings adapted to automatically switch between low and high engine idle speeds as a function of machine encountered workload. While the workload is at less than a pre-programmed setting, e.g. 90% of target as shown, the engine will continue to maintain a low idle speed. However, upon increase in workload to or beyond the pre-programmed setting, the engine speed may be automatically shifted to the higher power engine idle. The engine may then remain at high idle until the workload has subsequently fallen below a predetermined setting, e.g. 50% of target as shown. In addition to the automated functions of the autoadaptive mode 60, such as being responsive to workload declines below such predetermined settings, a timer function may be incorporated to reduce undesirable cycling between modes.

In accordance with the algorithm displayed in FIG. 3, however, the timer function is not shown to be deployed upon workload increases; i.e. in advance of an automatic switch to power idle. The avoidance of timer induced delays upon switching the engine idle from economy mode to power mode may better assure instantaneous power upon demand, and thus avoiding bogging down of the engine upon encountering a spike or transient workload increase during an economy idle condition, as may be appreciated by those skilled in the art.

INDUSTRIAL APPLICABILITY

The disclosed autoadaptive mode may be useful in a variety of machines beyond paving machines, including wheel loaders, excavators, tractors, trucks, and other off-road machines. As disclosed herein, the described engine idle control system may be beneficial for optimizing fuel usage, as well as for lowering the overall engine noise profiles of associated machines.

One exemplary example of operation of the autoadaptive mode in the machine 10 may be described as follows.

From either standard economy mode 52 or normal power mode 54, the machine may be switched to the auto adaptive mode 60 via manipulation of the engine idle speed controller 50 by an operator. In the autoadaptive mode 60, the ECM 70 may automate engine idle functions. For example, the engine may initially operate within a range of 1500 to 1800 RPM, and may operate at a specific idle speed of 1650 RPM whenever the machine is initially placed into gear, providing that the parking brake has been deactivated.

As the workload demand on the machine 10 may subsequently increase to a value within a range of 75 to 95% of target workload, for example to an approximate value of 90%, the engine speed may be automatically increased to a high idle position. The engine may then remain at a high idle until the machine workload is reduced to a value within a range of 40 to 60% of target workload, for example to an approximate value of 50%, and an operator configurable timer pre-set time period has elapsed. Such time period may be within a range of 5 to 15 seconds, such as, for example, 10 seconds. At this point the engine speed may be returned to its low or economy mode setting. Alternatively, and at any time, the engine speed may be changed by manual intervention of the operator.

A method of automatically controlling engine idle speed of an engine in a machine 10 as a function of workload encountered by the machine in accordance with the disclosed autoadaptive mode 60 may include:

providing a selectable automated engine idle mode 60 in the machine;

providing an ECM 70 operable with, and in signal communication with, the automated engine idle mode 60;

programming the ECM 70 to default the engine speed to a predetermined economy idle mode setting upon initial engagement of the automated engine idle mode 60;

having the ECM 70 determine whether the machine workload has increased or decreased to a predetermined threshold value; and having the ECM 70 read the engine speed and to command a change of the engine speed to a higher value if machine workload has increased to a predetermined high threshold value, and to a lower value if machine workload has decreased to a predetermined low threshold value.

Although only one generally described embodiment of an autoadaptive engine idle control is disclosed herein, numerous other variations may fall within the spirit and scope of this disclosure. By way of example only, the target percentage thresholds may be varied, as may the configurable timer settings.

What is claimed is:

1. A paving machine comprising:

an engine, the engine having a high engine idle speed and a low engine idle speed;

a propel system for driving the machine;

an auger;

a screed;

a material feed system for moving an asphalt mix from a hopper to the auger;

a machine workload, the machine workload being a power drawn from the engine and consumed by the propel system, the auger, the screed, and the material feed system;

a controller; and an autoadaptive mode; wherein in the autoadaptive mode the controller determines a machine workload percentage which is a percentage of the machine workload compared to a target machine workload, compares the machine workload percentage to a first predetermined value, switches from a low engine idle speed to a high engine idle speed when the machine workload percentage is greater than or equal to the first predetermined value, compares the machine workload percentage to a second predetermined value, and switches from a high engine idle speed to a low engine idle speed when the machine workload percentage is less than or equal to the second predetermined value, wherein the first predetermined value is 90% and the second predetermined value is 65%.

2. The paving machine of claim 1, further comprising a timer and wherein in the autoadaptive mode, the controller switches from the high engine idle speed to the low engine idle speed when a predetermined time period has elapsed.

3. A paving machine comprising:

an engine, the engine having a high engine idle speed and a low engine idle speed;

a machine workload; and a controller;

wherein the workload comprises a plurality of loads powered by the engine; and wherein the controller determines a machine workload percentage which is a percentage of the machine workload compared to a target machine workload, and shifts the engine from the low engine idle speed to the high engine idle speed when the machine workload percentage is greater than or equal to 90%.

4. The paving machine of claim 3, wherein the plurality of loads comprises a propel system for driving the machine, an auger, a screed, and a material feed system for moving an asphalt mix from a hopper to the auger.

5. The paving machine of claim 3, wherein the controller switches from the high engine idle speed to the low engine idle speed when the machine workload percentage is less than or equal to 65%.

6. The paving machine of claim 5, further comprising a timer and wherein the controller shifts the engine between the low engine idle speed and the high engine idle speed when a predetermined time period has elapsed.

7. A paving machine comprising:

an engine having a first engine idle setting and a second engine idle setting, and a machine workload, wherein the workload comprises a plurality of loads powered by the engine;

wherein the engine switches from the second engine idle setting to the first engine idle setting when the machine workload percentage is less than or equal to 65%, the machine workload percentage is a percentage of the machine workload compared to a target machine workload.

8. The paving machine of claim 7, wherein the plurality of loads comprises a propel system for driving the machine and a screed.

9. The paving machine of claim 7, wherein the engine switches from the first engine idle setting to the second engine idle setting when the machine workload percentage is greater than or equal to 90%.

10. The paving machine of claim 9, wherein the engine switches between the first and second engine idle settings when a predetermined time period has elapsed.

* * * * *